US006597265B2

(12) United States Patent
Liang et al.

(10) Patent No.: US 6,597,265 B2
(45) Date of Patent: Jul. 22, 2003

(54) HYBRID RESONATOR MICROSTRIP LINE FILTERS

(75) Inventors: Xiao-Peng Liang, San Jose, CA (US); Yongfei Zhu, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/010,891

(22) Filed: Nov. 13, 2001

(65) Prior Publication Data

US 2002/0118081 A1 Aug. 29, 2002

Related U.S. Application Data

(60) Provisional application No. 60/248,479, filed on Nov. 14, 2000.

(51) Int. Cl.[7] ..... H01P 1/203

(52) U.S. Cl. ..... 333/204; 333/205

(58) Field of Search ..... 333/203, 204, 333/205, 235, 219

(56) References Cited

U.S. PATENT DOCUMENTS

| | | | |
|---|---|---|---|
| 3,348,173 | A | 10/1967 | Matthaei et al. |
| 3,745,489 | A | 7/1973 | Cristal et al. |
| 4,129,842 | A | 12/1978 | Torii et al. |
| 4,250,475 | A | 2/1981 | Schwarzmann |
| 4,266,206 | A | 5/1981 | Bedard et al. |
| 4,418,324 | A | 11/1983 | Higgins |
| 31,470 | A | 12/1983 | Bedard et al. |
| 4,551,696 | A | 11/1985 | Moutrie et al. |

(List continued on next page.)

FOREIGN PATENT DOCUMENTS

| | | | | |
|---|---|---|---|---|
| DE | 4135435 | A1 * | 4/1993 | ..... 333/204 |
| EP | 0423667 | A1 * | 4/1991 | ..... 333/203 |
| FR | 2613538 | A | 10/1998 | |

OTHER PUBLICATIONS

U. H. Gysel, "New Theory and Design for Hairpin–Line Filters," *IEEE Transactions on Microwave Theory and Techniques*, vol. 22, No. 5, May 1974, pp. 523–531.

O.G. Vendik et al., "Ferroelectric Tuning of Planar and Bulk Microwave Devices," *Journal of Superconductivity*, vol. 12, No. 2, Apr. 1999, pp. 325–338.

X. –P. Liang et al., "Hybrid Resonator Microstrip Line Electrically Tunable Filter," *2001 MTT–S International Microwave Symposium—Digest*, May 20–25, 2001, pp. 1457–1460.

G. Matthaei et al., "Hairpin–Comb Filters for HTS and Other Narrow–Band Applications," *IEEE Transactions on Microwave Theory and Techniques*, vol. 45, No. 8, Aug. 1997, pp. 1226–1231.

R. Greed et al., "Microwave Applications of High Temperature Superconductors," *GEC Review*, vol. 14, No. 2, 1999, pp. 103–114.

(List continued on next page.)

*Primary Examiner*—Seungsook Ham

(74) *Attorney, Agent, or Firm*—Robert P. Lenart; James S. Finn

(57) ABSTRACT

An electronic filter includes a substrate, a ground conductor, a plurality of linear microstrips positioned on a the substrate with each having a first end connected to the ground conductor. A capacitor is connected between a second end of the each of the linear microstrips and the ground conductor. A U-shaped microstrip is positioned adjacent the linear microstrips, with the U-shaped microstrip including first and second extensions positioned parallel to the linear microstrips. Additional capacitors are connected between a first end of the first extension of the U-shaped microstrip and the ground conductor, and between a first end of the second extension of the U-shaped microstrip and the ground conductor. Additional U-shaped microstrips can be included. An input can coupled to one of the linear microstrips or to one of the extensions of the U-shaped microstrips. An output can be coupled to another one of the linear microstrips or to another extension of one of the U-shaped microstrips. The capacitors can be voltage tunable dielectric capacitors.

14 Claims, 7 Drawing Sheets

U.S. PATENT DOCUMENTS

| | | | | | |
|---|---|---|---|---|---|
| 4,578,656 | A | | 3/1986 | Lacour et al. | |
| 4,757,287 | A | | 7/1988 | Grandfield et al. | |
| 4,799,034 | A | | 1/1989 | Silverman et al. | |
| 4,835,499 | A | | 5/1989 | Pickett | |
| 4,992,759 | A | * | 2/1991 | Giraudeau et al. | 333/204 |
| 5,021,757 | A | * | 6/1991 | Kobayashi et al. | 333/204 |
| 5,138,288 | A | | 8/1992 | Blackburn | |
| 5,227,748 | A | | 7/1993 | Sroka | |
| 5,241,291 | A | | 8/1993 | Blackburn | |
| 5,427,988 | A | | 6/1995 | Sengupta et al. | |
| 5,442,330 | A | | 8/1995 | Fuller et al. | |
| 5,448,210 | A | | 9/1995 | Marcoux | |
| 5,483,206 | A | | 1/1996 | Lohninger | |
| 5,543,764 | A | | 8/1996 | Turunen et al. | |
| 5,635,433 | A | | 6/1997 | Sengupta | |
| 5,635,434 | A | | 6/1997 | Sengupta | |
| 5,640,042 | A | | 6/1997 | Koscica et al. | |
| 5,693,429 | A | | 12/1997 | Sengupta et al. | |
| 5,766,697 | A | | 6/1998 | Sengupta et al. | |
| 5,830,591 | A | | 11/1998 | Sengupta et al. | |
| 5,846,893 | A | | 12/1998 | Sengupta et al. | |
| 5,888,942 | A | | 3/1999 | Matthaei | |
| 6,018,282 | A | * | 1/2000 | Tsuda | 333/205 |
| 6,074,971 | A | | 6/2000 | Chiu et al. | |
| 6,097,263 | A | * | 8/2000 | Mueller et al. | 333/235 |

OTHER PUBLICATIONS

A. Brown et al., "*A Varactor Tuned RF Filter*," IEEE Trans. on MTT, Oct. 29, 1999, p. 1–4.

G. Torregrosa–Penalva et al., "A Simple Method to Design Wideband Electronically Tunable Combline Filters," *IEEE Transactions on Microwave Theory and Techniques*, vol. XX, No. Y, 2001, pp. 1–6.

U.S. patent application Ser. No. 09/419,126 (filed Oct. 15, 1999).

U.S. patent application Ser. No. 09/594,837 (filed Jun. 15, 2000).

U.S. patent application Ser. No. 09/734,969 (filed Dec. 12, 2000).

U.S. patent application Ser. No. 09/768690 (filed Jan. 24, 2001).

U.S. patent application Ser. No. 09/834,327 (filed Apr. 13, 2001).

U.S. patent application Ser. No. 09/882,605 (filed Jun. 15, 2001).

U.S. patent application Ser. No. 09/295,046 (filed Jun. 01, 2001).

* cited by examiner

HYBRID RESONATOR MICROSTRIP LINE FILTERS

CROSS REFERENCE TO RELATED APPLICATION

This application claims the benefit of the filing date of U.S. Provisional Application No. 60/248,479, filed Nov. 14, 2000.

FIELD OF INVENTION

The present invention relates generally to electronic filters, and more particularly, to microstrip filters that operate at microwave and radio frequency frequencies.

BACKGROUND OF INVENTION

Wireless communications applications have increased to crowd the available spectrum and drive the need for high isolation between adjacent bands. Portability requirements of mobile communications additionally require a reduction in the size of communications equipment. Filters used in communications devices have been required to provide improved performance using smaller sized components. Efforts have been made to develop new types of resonators, new coupling structures, and new configurations to address these requirements.

Combline filters are attractive for use in electronic communications devices. It is well known that combline filters, in general, have a natural transmission zero above its passband. One of the techniques used to reduce the number of resonators is to add cross couplings between non-adjacent resonators to provide transmission zeros. An example of this approach is shown in U.S. Pat. No. 5,543,764. As a result of these transmission zeros, filter selectivity is improved. However, in order to achieve these transmission zeros, certain coupling patterns have to be followed. This turns out to diminish the size reduction effort. In filters for wireless mobile and portable communication applications, small size and coupling structure design requirements mean that adding cross coupling to achieve transmission zeros is not a good option.

Electrically tunable microwave filters have many applications in microwave systems. These applications include local multipoint distribution service (LMDS), personal communication systems (PCS), frequency hopping radio, satellite communications, and radar systems. There are three main kinds of microwave tunable filters, mechanically, magnetically, and electrically tunable filters. Mechanically tunable filters suffer from slow tuning speed and large size. A typical magnetically tunable filter is the YIG (Yttrium-Iron-Garnet) filter, which is perhaps the most popular tunable microwave filter, because of its multioctave tuning range, and high selectivity. However, YIG filters have low tuning speed, complex structure, and complex control circuits, and are expensive.

One electronically tunable filter is the diode varactor-tuned filter, which has a high tuning speed, a simple structure, a simple control circuit, and low cost. Since the diode varactor is basically a semiconductor diode, diode varactor-tuned filters can be used in monolithic microwave integrated circuits (MMIC) or microwave integrated circuits. The performance of varactors is defined by the capacitance ratio, $C_{max}/C_{min}$, frequency range, and figure of merit, or Q factor at the specified frequency range. The Q factors for semiconductor varactors for frequencies up to 2 GHz are usually very good. However, at frequencies above 2 GHz, the Q factors of these varactors degrade rapidly.

Electronically tunable filters have been proposed that use electronically tunable varactors in combination with the filter's resonators. When the varactor capacitance is changed, the resonator resonant frequency changes, which results in a change in the filter frequency. Electronically tunable filters have the advantages of small size, lightweight, low power consumption, simple control circuits, and fast tuning capability. Electronically tunable filters have used semiconductor diodes as the tunable capacitance. Compared with semiconductor diode varactors, tunable dielectric varactors have the advantages of lower loss, higher power handling, higher IP3, and faster tuning speed.

Commonly owned U.S. patent application Ser. No. 09/419,126, filed Oct. 15, 1999, and titled "Voltage Tunable Varactors And Tunable Devices Including Such Varactors", discloses voltage tunable dielectric varactors that operate at room temperature and various devices that include such varactors, and is hereby incorporated by reference.

Commonly owned U.S. patent application Ser. No. 09/734,969, filed Dec. 12, 2000, and titled "Electronic Tunable Filters With Dielectric Varactors", discloses microstrip filters including voltage tunable dielectric varactors that operate at room temperature, and is hereby incorporated by reference.

For miniaturization, hairpin resonator structures have been widely used in microstrip line filters, especially for high temperature superconductors (HTS). It has been noticed that a transmission zero at the low frequency side is found, which results in the filter selectivity at the low frequency side to be improved and at the high frequency side to be degraded, even though, theoretical analysis shows that the transmission zero should be at the high frequency side.

It would be desirable to provide a microstrip line filter that includes transmission zeros, but does not require cross coupling between non-adjacent resonators.

SUMMARY OF THE INVENTION

The electronic filters of this invention include a substrate, a ground conductor, a plurality of linear microstrips positioned on a the substrate with each having a first end connected to the ground conductor. A capacitor is connected between a second end of the each of the linear microstrips and the ground conductor. A U-shaped microstrip is positioned adjacent the linear microstrips, with the U-shaped microstrip including first and second extensions positioned parallel to the linear microstrips. Additional capacitors are connected between a first end of the first extension of the U-shaped microstrip and the ground conductor, and between a first end of the second extension of the U-shaped microstrip and the ground conductor. Additional U-shaped microstrips can be included. An input can coupled to one of the linear microstrips or to one of the extensions of the U-shaped microstrips. An output can be coupled to another one of the linear microstrips or to another extension of one of the U-shaped microstrips. The capacitors can be fixed or tunable capacitors. Fixed capacitors would be used to construct filters having a fixed frequency response. Tunable capacitors would be used to construct filters having a tunable frequency response. The tunable capacitors can be voltage tunable dielectric varactors.

This invention provides electronic filters including a substrate, a ground conductor, a first linear microstrip positioned on a first surface of the substrate and having a first end connected to the ground conductor, a first capacitor connected between a second end of the first linear microstrip and the ground conductor, a second linear microstrip, positioned on the first surface of the substrate parallel to the first linear microstrip, and having a first end connected to the ground conductor, a second capacitor connected between a second end of the second linear microstrip and the ground conductor, a third linear microstrip positioned on the first surface of the substrate between the first and second linear microstrips and parallel to the first and second linear microstrips, and having a first end connected to the ground conductor, a third capacitor connected between a second end of the third linear microstrip and the ground conductor, a U-shaped microstrip positioned between the first and third linear microstrips, the U-shaped microstrip including first and second extensions positioned parallel to the first, second and third linear microstrips, a fourth capacitor connected between a first end of the first extension of the U-shaped microstrip and the ground conductor, a fifth capacitor connected between a first end of the second extension of the U-shaped microstrip and the ground conductor, an input coupled to the first linear microstrip, and an output coupled to the second linear microstrip.

The invention also encompasses electronic filters including a substrate, a ground conductor, a first linear microstrip positioned on a first surface of the substrate and having a first end connected to the ground conductor, a first capacitor connected between a second end of the first linear microstrip and the ground conductor, a second linear microstrip, positioned on the first surface of the substrate parallel to the first linear microstrip, and having a first end connected to the ground conductor, a second capacitor connected between a second end of the second linear microstrip and the ground conductor, a first U-shaped microstrip positioned between the first and second linear microstrips, the first U-shaped microstrip including first and second extensions positioned parallel to the first and second linear microstrips, a third capacitor connected between a first end of the first extension of the first U-shaped microstrip and the ground conductor, a fourth capacitor connected between a first end of the second extension of the first U-shaped microstrip and the ground conductor, a second U-shaped microstrip positioned between the first and second linear microstrips, the second U-shaped microstrip including third and fourth extensions positioned parallel to the first and second linear microstrips, a fifth capacitor connected between a first end of the third extension of the second U-shaped microstrip and the ground conductor, a sixth capacitor connected between a first end of the fourth extension of the second U-shaped microstrip and the ground conductor, an input coupled to the first linear microstrip, and an output coupled to the second linear microstrip.

The invention further encompasses electronic filters including a substrate, a ground conductor, a first linear microstrip positioned on a first surface of the substrate and having a first end connected to the ground conductor, a first capacitor connected between a second end of the first linear microstrip and the ground conductor, a second linear microstrip, positioned on the first surface of the substrate parallel to the first linear microstrip, and having a first end connected to the ground conductor, a second capacitor connected between a second end of the second linear microstrip and the ground conductor, a first U-shaped microstrip positioned between the first and second linear microstrips, the first U-shaped microstrip including first and second extensions positioned parallel to the first and second linear microstrips, a third capacitor connected between a first end of the first extension of the first U-shaped microstrip and the ground conductor, a fourth capacitor connected between a first end of the second extension of the first U-shaped microstrip and the ground conductor, a second U-shaped microstrip positioned between the first and second linear microstrips, the second U-shaped microstrip including third and fourth extensions positioned parallel to the first and second linear microstrips, a fifth capacitor connected between a first end of the third extension of the second U-shaped microstrip and the ground conductor, a sixth capacitor connected between a first end of the fourth extension of the second U-shaped microstrip and the ground conductor, an input coupled to the first extension of the first U-shaped microstrip, and an output coupled to the fourth extension of the second U-shaped microstrip.

The filters of this invention can utilize combinations of combline and hairpin resonators to provide transmission zeros at both the upper and lower sides of the filter passband. Tunable versions of the filters provide consistent bandwidth and insertion loss in the tuning range.

DETAILED DESCRIPTION OF THE INVENTION

Figure 1:
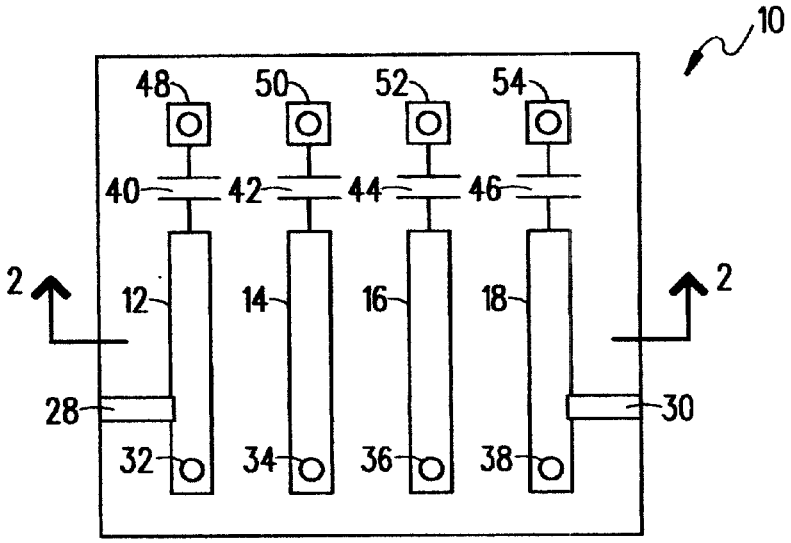
FIG. 1 (PRIOR ART)
FIG. 1 is a plan view of a 4-pole microstrip combline filter.
Figure 2:
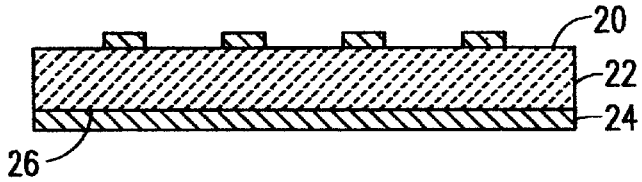
FIG. 2 (PRIOR ART)
FIG. 2 is a cross sectional view of the filter of FIG. 1, taken along line 2—2.

Referring to the drawings, FIG. 1 is a plan view of a 4-pole microstrip combline filter 10, and FIG. 2 is a cross sectional view of the filter of FIG. 1, taken along line 2—2. The filter of FIGS. 1 and 2 includes a plurality of linear microstrip resonators 12, 14, 16 and 18 mounted on a first surface 20 of a dielectric substrate 22. A ground plane conductor 24 is positioned on a second surface 26 of the substrate 22. An input 28 is connected to resonator 12 and an output 30 is connected to resonator 18. One end of each of the resonators 12, 14, 16 and 18 is connected to the ground plane by vias 32, 34, 36 and 38. Capacitors 40, 42, 44 and 46 are connected between a second end of each of the resonators and the ground plane by vias 48, 50, 52 and 54.

Figure 3:
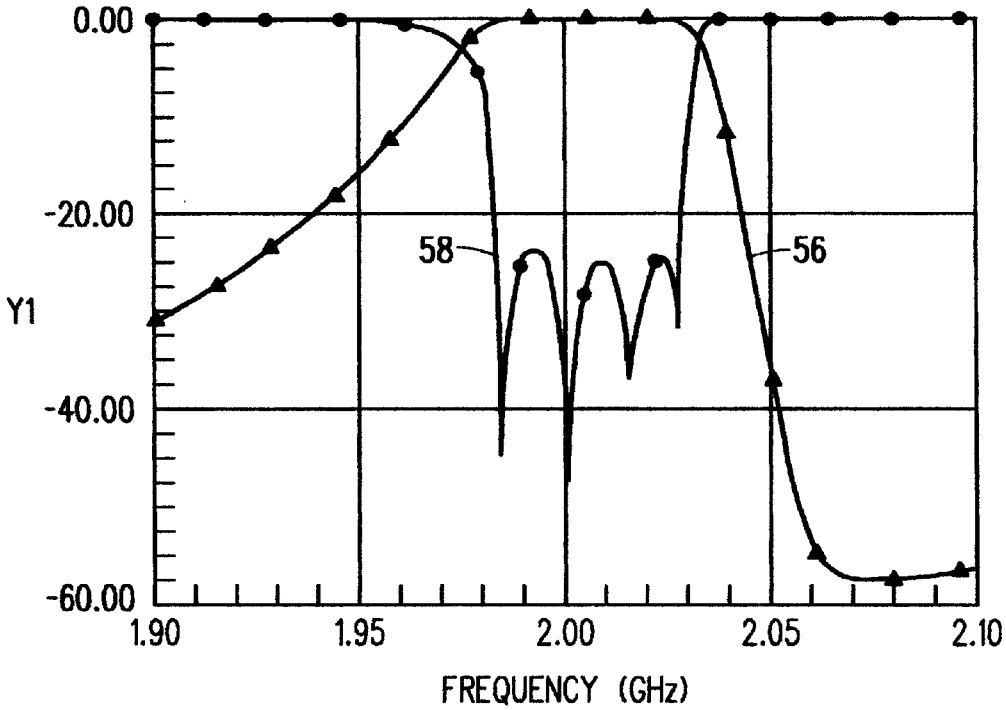
FIG. 3 is a graph of the passband of the filter of FIG. 1.

FIG. 3 is a graph of the passband of the filter of FIGS. 1 and 2. FIG. 3 shows the insertion loss (S21) 56 of the filter of FIGS. 1 and 2. As shown in FIG. 3, the filter response 56 is skewed by the transmission zero at the high frequency side, which results in an improvement in the filter selectivity at the high frequency side and a degradation in the filter selectivity at the low frequency side. Curve 58 represents the return loss (S11).

Figure 4:
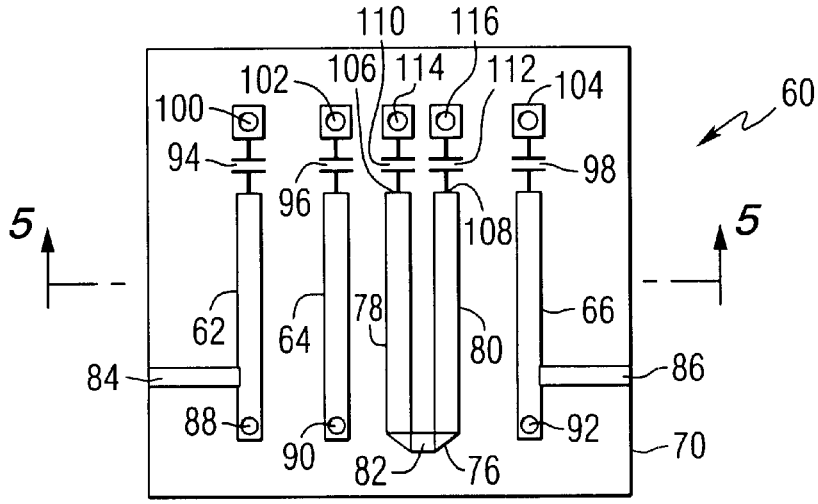
FIG. 4 is a plan view of a tunable filter constructed in accordance with this invention.
Figure 5:
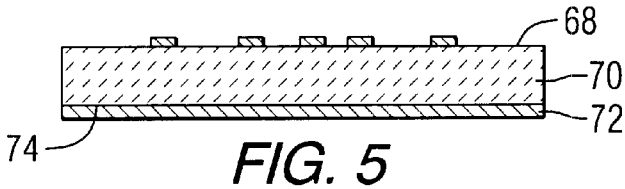
FIG. 5 is a cross sectional view of the filter of FIG. 4, taken along line 5—5.

FIG. 4 is a plan view of a tunable filter 60 constructed in accordance with this invention, and FIG. 5 is a cross sectional view of the filter of FIG. 4, taken along line 5—5. The filter of FIGS. 4 and 5 includes a plurality of linear microstrip resonators 62, 64 and 66 mounted on a first surface 68 of a dielectric substrate 70. A ground plane conductor 72 is positioned on a second surface 74 of the substrate 70. A hairpin resonator 76 is positioned between resonators 64 and 66. The hairpin resonator 76 includes first and second linear microstrip extensions 78 and 80 that are shorted together at by a shorting conductor 82. An input 84 is connected to resonator 62 and an output 86 is connected to resonator 66. One end of each of the resonators 62, 64 and 66 is connected to the ground plane by vias 88, 90 and 92. Capacitors 94, 96 and 98 are connected between a second end of each of the resonators 62, 64 and 66 and the ground plane by vias 100, 102 and 104. Ends 106 and 108 of the hairpin resonator extensions 78 and 80, are connected to capacitors 110 and 112, which are in turn connected to the ground plane by vias 114 and 116.

Figure 6:
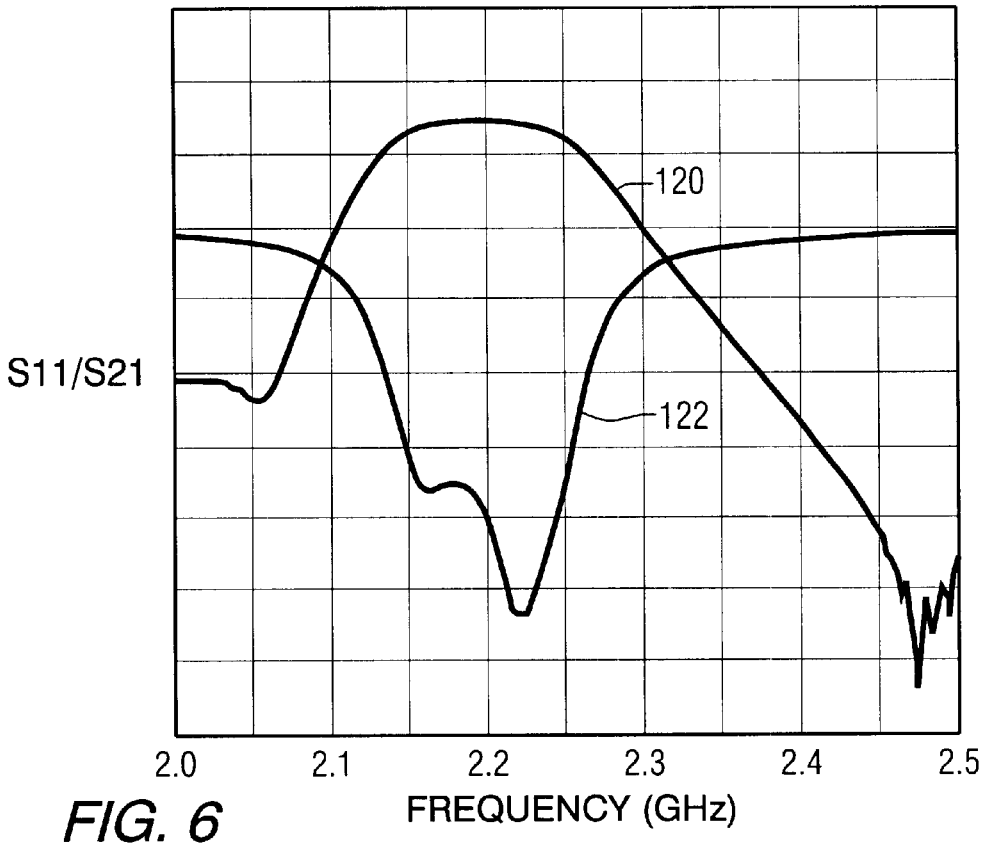
FIG. 6 is a graph of the passband of the filter of FIG. 4.

Tunable filter 60 is an example of a 4-pole Chebyshev microstrip line hybrid resonator bandpass filter. In on example, the microstrip line substrate has a dielectric constant of 10.2 and a thickness of %25 inches. The input and output resonators, and one of the two middle resonators are typical combline resonators with one end of the resonator grounded through a via hole and the other end connected with a varactor. The varactor is then grounded through a DC block capacitor. DC voltage bias is applied, by conductors not shown in this view, to the varactors to provide tunability. The last resonator is a U-shaped hairpin like resonator. Usually, hairpin resonators do not require end capacitance. This hairpin resonator is connected with a varactor at each end for tunability. The two end varactors are grounded directly. The DC voltage bias is can be applied to the middle point of the U-shaped hairpin resonator, which is ideally a short point for the resonator. Filter inputs and outputs are tapped to the first and last resonators. This filter design works at 2.0 GHz. The filter passband insertion loss (S21) is shown as curve 120 in FIG. 6. It can be seen that a transmission zero at each end of the filter passband is clearly demonstrated. Curve 122 in FIG. 6 illustrates the return loss (S11).

Figure 7:
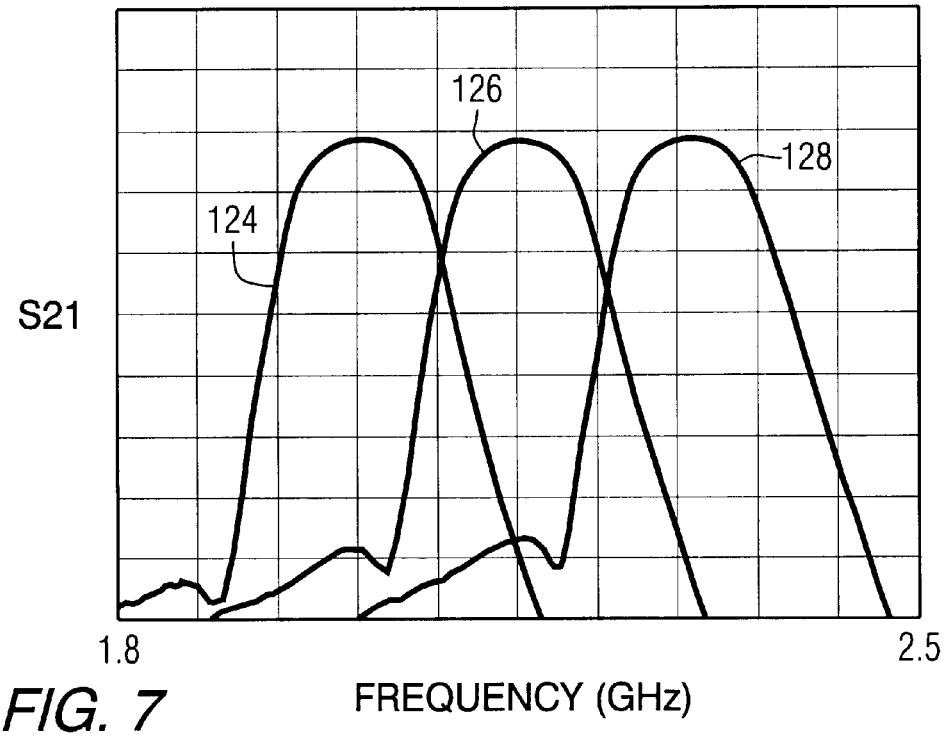
FIG. 7 is a graph of the passband of the filter of FIG. 4 at different bias voltages on the tunable capacitors.

FIG. 7 shows the insertion loss (S21) responses for an example filter using thin film tunable varactors with different DC voltages applied to the varactors. Curve 124 represents the insertion loss at 50 volts bias voltage on the varactors, curve 126 represents the insertion loss at 90 volts bias voltage on the varactors and curve 128 represents the insertion loss at a bias voltage of 150 volts on the varactors. Curves 124 and 128 show that the filter has more than 300 MHz of frequency tunability. It can be seen from these curves, that the filter shows a consistent bandwidth and insertion loss in the tuning range. In addition, transmission zeros are kept at similar positions relative to the center frequency of the tuning range.

Figure 8:
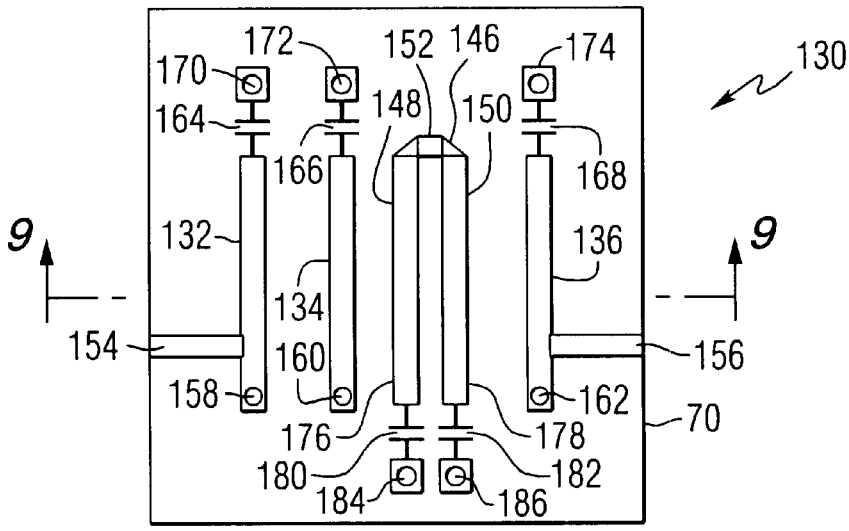
FIG. 8 is a plan view of alternative tunable filter constructed in accordance with this invention.
Figure 9:
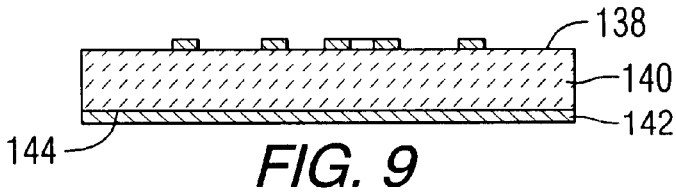
FIG. 9 is a cross sectional view of the filter of FIG. 8, taken along line 9—9.

FIGS. 8 and 9 illustrate an alternative example of a filter 130 constructed in accordance with this invention. The filter of FIG. 8 includes a plurality of linear microstrip resonators 132, 134 and 136 mounted on a first surface 138 dielectric substrate 140. A ground plane conductor 142 is positioned on a second surface 144 of the substrate 140. A hairpin resonator 146 is positioned between resonators 134 and 136. The hairpin resonator 146 includes first and second linear microstrip extensions 148 and 150 the are shorted together at by a shorting conductor 152. An input 154 is connected to resonator 132 and an output 156 is connected to resonator 136. One end of each of the resonators 132, 134 and 136 is connected to the ground plane by vias 158, 160 and 162. Capacitors 164, 166 and 168 are connected between a second end of each of the resonators 132, 134 and 136 and the ground plane by vias 170, 172 and 174. Ends 176 and 178 of the hairpin resonator extensions 148 and 150, are connected to capacitors 180 and 182, which are in turn connected to the ground plane by vias 184 and 186.

In FIGS. 8 and 9, the one hairpin like resonator is oriented in the opposite direction as the other three combline resonators. In FIGS. 5 and 6, since that one hairpin like resonator is oriented in the same direction as the other three combline resonators, the coupling between the two different types of resonators is just like the coupling between two combline resonators. While in FIGS. 8 and 9, the coupling between the two different types of resonators is just like the coupling between two interdigital resonators.

Figure 10:
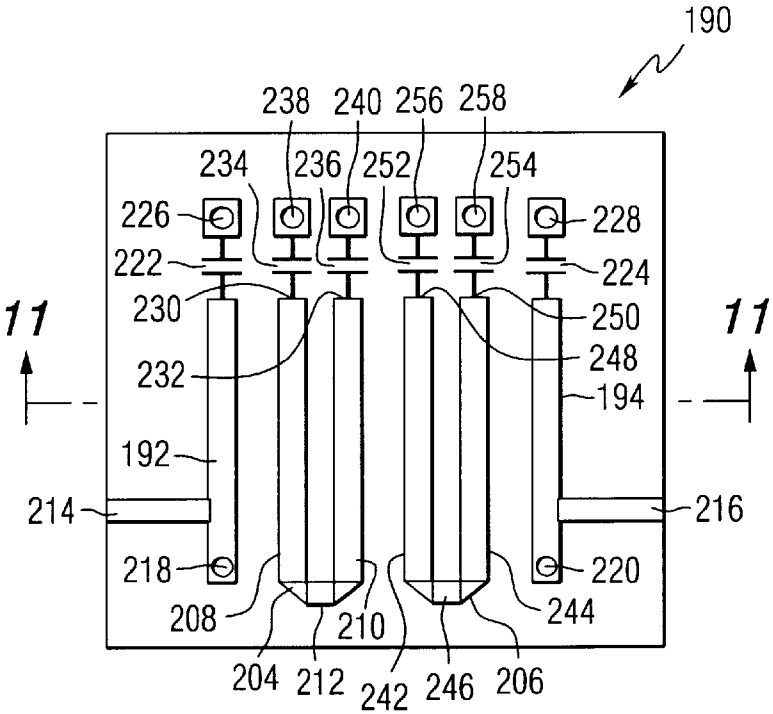
FIG. 10 is a plan view of alternative tunable filter constructed in accordance with this invention.
Figure 11:
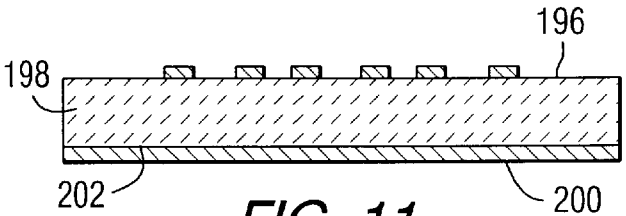
FIG. 11 is a cross sectional view of the filter of FIG. 10, taken along line 11—11.

FIGS. 10 and 11 illustrate an alternative example of a filter 190 constructed in accordance with this invention. The filter of FIG. 10 includes two linear microstrip resonators 192 and 194 mounted on a first surface 196 dielectric substrate 198. A ground plane conductor 200 is positioned on a second surface 202 of the substrate 198. Two hairpin resonators 204 and 206 are positioned between resonators 192 and 194. The first hairpin resonator 204 includes first and second linear microstrip extensions 208 and 210 the are shorted together at by a shorting conductor 212. An input 214 is connected to resonator 192 and an output 216 is connected to resonator 194. One end of each of the resonators 192 and 194 is connected to the ground plane by vias 218 and 220. Capacitors 222 and 224 are connected between a second end of each of the resonators 192 and 194 and the ground plane by vias 226 and 228. Ends 230 and 232 of the hairpin resonator extensions 208 and 210, are connected to capacitors 234 and 236, which are in turn connected to the ground plane by vias 238 and 240. The second hairpin resonator 206 includes first and second linear microstrip extensions 242 and 244 the are shorted together at by a shorting conductor 246. Ends 248 and 250 of the hairpin resonator extensions 242 and 244, are connected to capacitors 252 and 254, which are in turn connected to the ground plane by vias 256 and 258.

Figure 12:
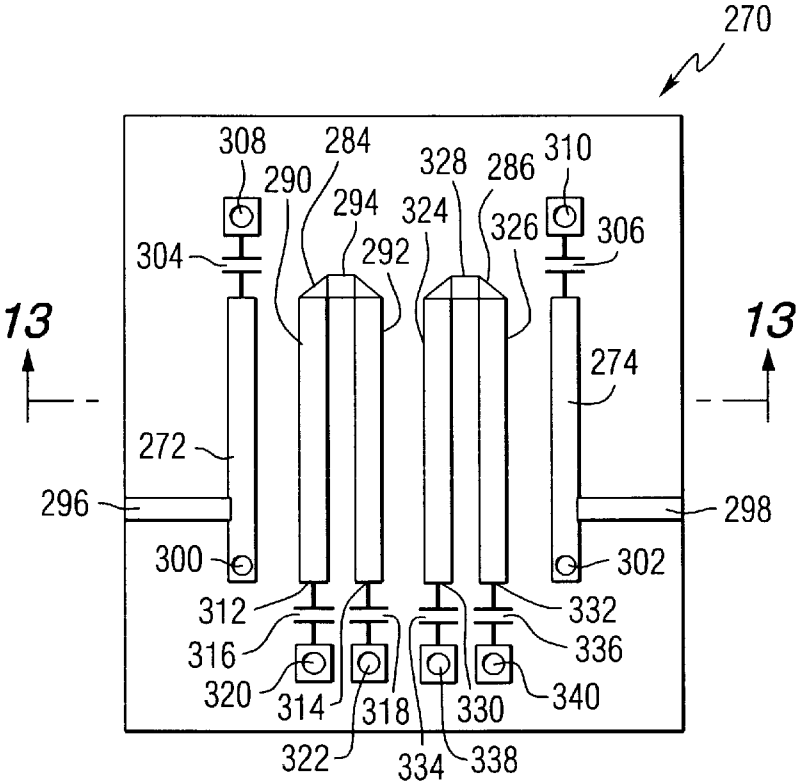
FIG. 12 is a plan view of alternative tunable filter constructed in accordance with this invention.
Figure 13:
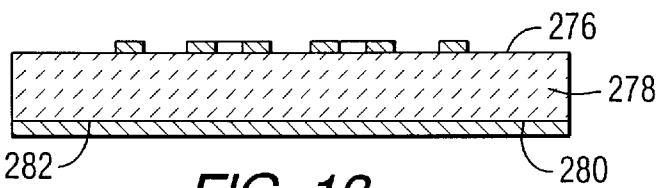
FIG. 13 is a cross sectional view of the filter of FIG. 12, taken along line 13—13.

FIGS. 12 and 13 illustrate an alternative example of a filter 270 constructed in accordance with this invention. The filter of FIG. 12 includes two linear microstrip resonators 272 and 274 mounted on a first surface 276 dielectric substrate 278. A ground plane conductor 280 is positioned on a second surface 282 of the substrate 278. Two hairpin resonators 284 and 286 are positioned between resonators 272 and 274. The first hairpin resonator 284 includes first and second linear microstrip extensions 290 and 292 the are shorted together at by a shorting conductor 294. An input 296 is connected to resonator 272 and an output 298 is connected to resonator 274. One end of each of the resonators 272 and 274 is connected to the ground plane by vias 300 and 302. Capacitors 304 and 306 are connected between a second end of each of the resonators 272 and 274 and the ground plane by vias 308 and 310. Ends 312 and 314 of the hairpin resonator extensions 290 and 292, are connected to capacitors 316 and 318, which are in turn connected to the ground plane by vias 320 and 322. The second hairpin resonator 286 includes first and second linear microstrip extensions 324 and 326 the are shorted together at by a shorting conductor 328. Ends 330 and 332 of the hairpin resonator extensions 324 and 326, are connected to capacitors 334 and 336, which are in turn connected to the ground plane by vias 338 and 340.

FIGS. 10 and 12 show a combination of different types of resonators. Two hairpin like resonators are used as the middle two resonators. One configuration of this combination is to have both hairpin resonators oriented in the same direction as the combline resonators, while the other configuration is to have the hairpin resonators oriented in the opposite direction.

Figure 14:
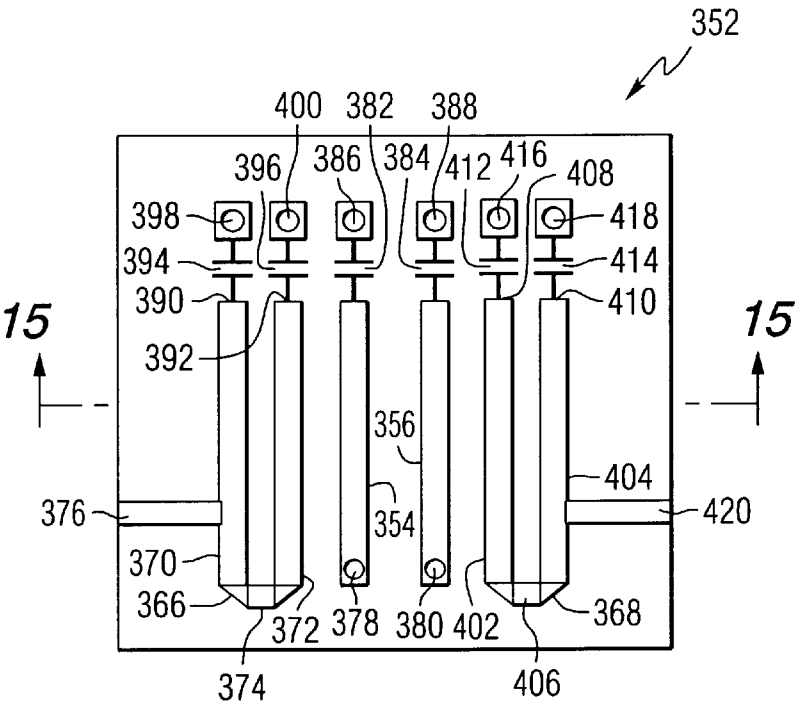
FIG. 14 is a plan view of alternative tunable filter constructed in accordance with this invention.
Figure 15:
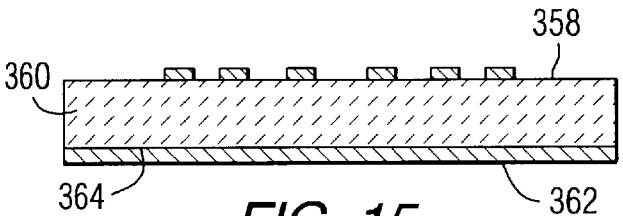
FIG. 15 is a cross sectional view of the filter of FIG. 14, taken along line 15—15.

FIGS. 14 and 15 illustrate an alternative example of a filter 352 constructed in accordance with this invention. The filter of FIG. 14 includes two linear microstrip resonators 354 and 356 mounted on a first surface 358 dielectric substrate 360. A ground plane conductor 362 is positioned on a second surface 364 of the substrate 360. Two hairpin resonators 366 and 368 are positioned adjacent to the sides of resonators 354 and 356. The first hairpin resonator 366 includes first and second linear microstrip extensions 370 and 372 the are shorted together at by a shorting conductor 374. An input 376 is connected to extension 370. One end of each of the resonators 354 and 356 is connected to the ground plane by vias 378 and 380. Capacitors 382 and 384 are connected between a second end of each of the resonators 354 and 356 and the ground plane by vias 386 and 388. Ends 390 and 392 of the hairpin resonator extensions 370 and 372, are connected to capacitors 394 and 396, which are in turn connected to the ground plane by vias 398 and 400. The second hairpin resonator 368 includes first and second linear microstrip extensions 402 and 404 the are shorted together at by a shorting conductor 406. Ends 408 and 410 of the hairpin resonator extensions 402 and 404, are connected to capacitors 412 and 414, which are in turn connected to the ground plane by vias 416 and 418. An output 420 is connected to extension 404.

Figure 16:
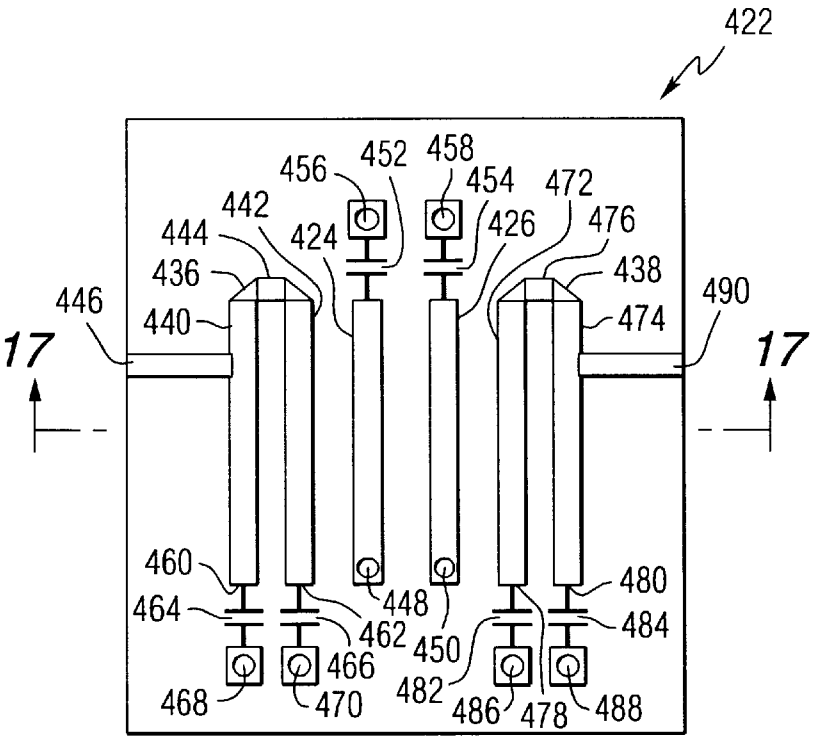
FIG. 16 is a plan view of alternative tunable filter constructed in accordance with this invention.
Figure 17:
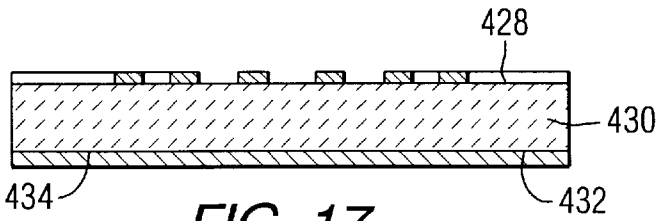
FIG. 17 is a cross sectional view of the filter of FIG. 16, taken along line 17—17.

FIGS. 16 and 17 illustrate an alternative example of a filter 422 constructed in accordance with this invention. The filter of FIG. 16 includes two linear microstrip resonators 424 and 426 mounted on a first surface 428 dielectric substrate 430. A ground plane conductor 432 is positioned on a second surface 434 of the substrate 430. Two hairpin resonators 436 and 438 are positioned adjacent to the sides of resonators 424 and 426. The first hairpin resonator 436 includes first and second linear microstrip extensions 440 and 442 the are shorted together at by a shorting conductor 444. An input 446 is connected to extension 440. One end of each of the resonators 424 and 426 is connected to the ground plane by vias 448 and 450. Capacitors 452 and 454 are connected between a second end of each of the resonators 424 and 426 and the ground plane by vias 456 and 458. Ends 460 and 462 of the hairpin resonator extensions 440 and 442, are connected to capacitors 464 and 466, which are in turn connected to the ground plane by vias 468 and 470. The second hairpin resonator 438 includes first and second linear microstrip extensions 472 and 474 the are shorted together at by a shorting conductor 476. Ends 478 and 480 of the hairpin resonator extensions 472 and 474, are connected to capacitors 482 and 484, which are in turn connected to the ground plane by vias 486 and 488. An output 490 is connected to extension 474.

FIGS. 14 and 16 show different combinations of the two different types of resonators. Two hairpin like resonators are now used as the input and output resonators, with the two combline resonators as the middle two resonators. The two hairpin like resonators can also be tapped. However, the tapped input and output will change the field balance in the hairpin like resonators and then the middle point of the resonator is no longer the short point. This is not good for bias addition. Furthermore, their imbalanced field distribution will affect the coupling between hairpin like resonators and combline resonator. In general, this combination is not preferred, but it may provide some useful features. For example, by using different combinations of hairpin and combline resonators, the transmission zero can be controlled. That is, filters can be constructed wherein the transmission zero is located on only one side of the passband. In addition, the position of the transmission zero relative to the center frequency and the transmission level can be controlled to optimize filter rejection.

Figure 18:
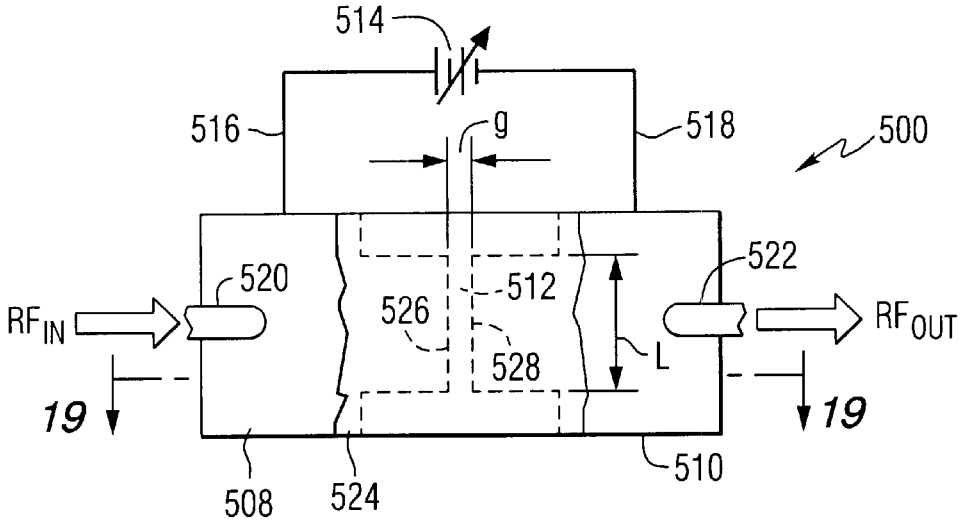
FIG. 18 is a top plan view of a voltage tunable dielectric varactor that can be used in the filters of the present invention.
Figure 19:
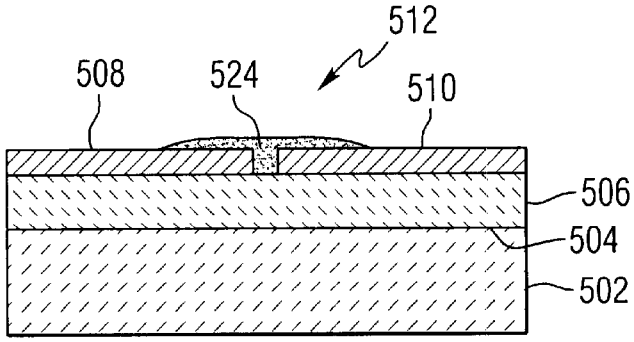
FIG. 19 is a cross sectional view of the varactor of FIG. 18, taken along line 19—19.

FIGS. 18 and 19 are top and cross sectional views of a tunable dielectric varactor 500 that can be used in filters constructed in accordance with this invention. The varactor 500 includes a substrate 502 having a generally planar top surface 504. A tunable ferroelectric layer 506 is positioned adjacent to the top surface of the substrate. A pair of metal electrodes 508 and 510 are positioned on top of the ferroelectric layer. The substrate 502 is comprised of a material having a relatively low permittivity such as MgO, Alumina, $LaAlO_3$, Sapphire, or a ceramic. For the purposes of this description, a low permittivity is a permittivity of less than about 30. The tunable ferroelectric layer 506 is comprised of a material having a permittivity in a range from about 20 to about 2000, and having a tunability in the range from about 10% to about 80% when biased by an electric field of about 10 V/$\mu$m. The tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. The tunable layer in one preferred embodiment of the varactor has a dielectric permittivity greater than 100 when subjected to typical DC bias voltages, for example, voltages ranging from about 5 volts to about 300 volts. A gap 22 of width g, is formed between the electrodes 18 and 20. The gap width can be optimized to increase the ratio of the maximum capacitance $C_{max}$ to the minimum capacitance $C_{min}$ ($C_{max}/C_{min}$) and increase the quality factor (Q) of the device. The optimal width, g, is the width at which the device has maximum $C_{max}/C_{min}$ and minimal loss tangent. The width of the gap can range from 5 to 50 μm depending on the performance requirements.

A controllable voltage source 514 is connected by lines 516 and 518 to electrodes 508 and 510. This voltage source is used to supply a DC bias voltage to the ferroelectric layer, thereby controlling the permittivity of the layer. The varactor also includes an RF input 520 and an RF output 522. The RF input and output are connected to electrodes 18 and 20, respectively, such as by soldered or bonded connections.

In typical embodiments, the varactors may use gap widths of less than 50 μm, and the thickness of the ferroelectric layer ranges from about 0.1 μm to about 20 μm. A sealant 524 can be positioned within the gap and can be any non-conducting material with a high dielectric breakdown strength to allow the application of high voltage without arcing across the gap. Examples of the sealant include epoxy and polyurethane.

The length of the gap L can be adjusted by changing the length of the ends 36 and 38 of the electrodes. Variations in the length have a strong effect on the capacitance of the varactor. The gap length can be optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$. The optimum thickness of the ferroelectric layer is the thickness at which the maximum $C_{max}/C_{min}$ occurs. The ferroelectric layer of the varactor of FIGS. 18 and 19 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.001 to about 0.005. For operation at frequencies ranging from about 10 GHz to about 20 GHz, the loss tangent would range from about 0.005 to about 0.01. For operation at frequencies ranging from about 20 GHz to about 30 GHz, the loss tangent would range from about 0.01 to about 0.02.

The electrodes may be fabricated in any geometry or shape containing a gap of predetermined width. The required current for manipulation of the capacitance of the varactors disclosed in this invention is typically less than 1 μA. In the preferred embodiment, the electrode material is gold. However, other conductors such as copper, silver or aluminum, may also be used. Gold is resistant to corrosion and can be readily bonded to the RF input and output. Copper provides high conductivity, and would typically be coated with gold for bonding or nickel for soldering.

Figure 20:
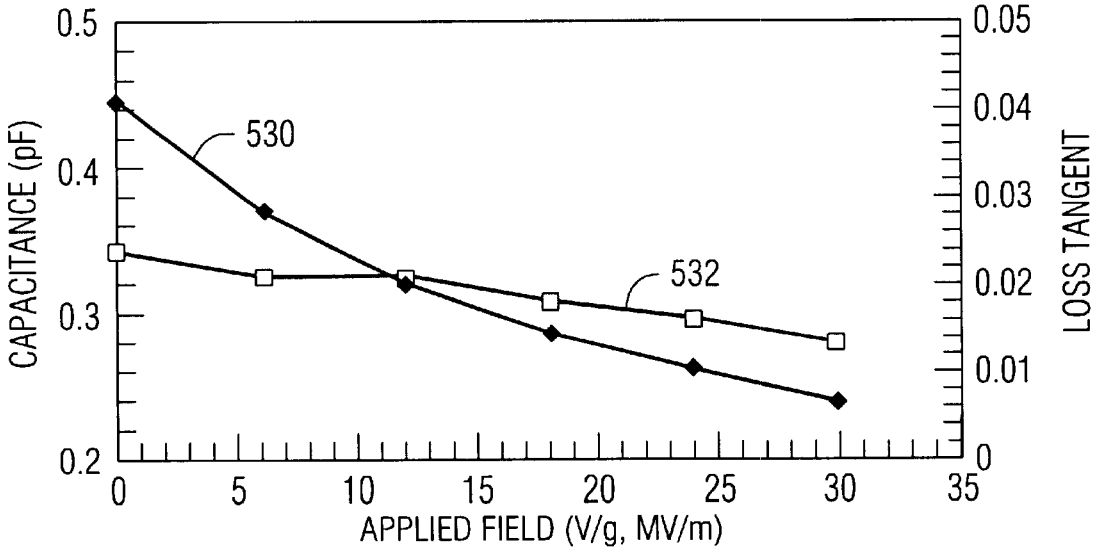
FIG. 20 is a graph that illustrates the properties of the dielectric varactor of FIG. 18.

Voltage tunable dielectric varactors as shown in FIGS. 18 and 19 can have Q factors ranging from about 50 to about 1,000 when operated at frequencies ranging from about 1 GHz to about 40 GHz. The typical Q factor of the dielectric varactor is about 1000 to 200 at 1 GHz to 10 GHz, 200 to 100 at 10 GHz to 20 GHz, and 100 to 50 at 20 to 30 GHz. $C_{max}/C_{min}$ is about 2, which is generally independent of frequency. The capacitance (in pF) and the loss factor (tan δ) of a varactor measured at 20 GHz for gap distance of 10 μm at 300° K. is shown in FIG. 20. Line 530 represents the capacitance and line 532 represents the loss tangent.

Figure 21:
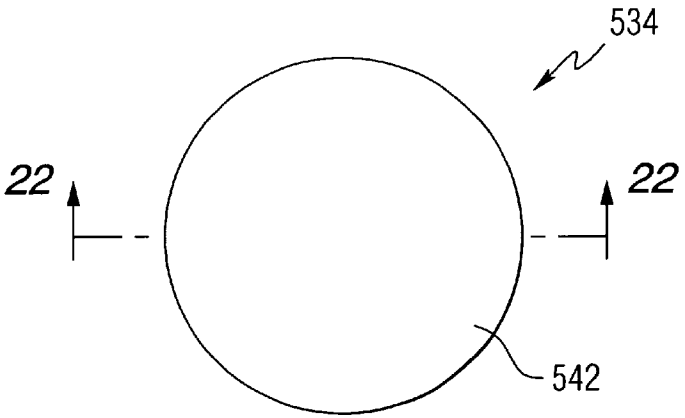
FIG. 21 is a top plan view of another voltage tunable dielectric varactor that can be used in the filters of the present invention.
Figure 22:
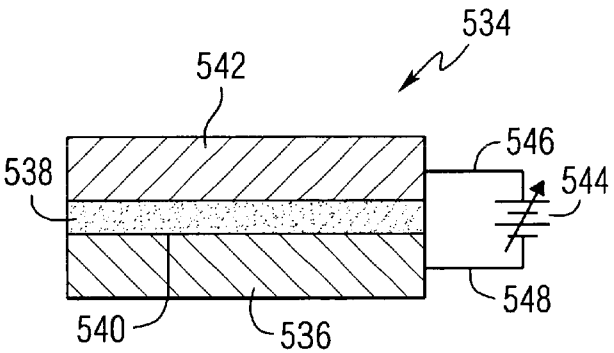
FIG. 22 is a cross sectional view of the varactor of FIG. 21, taken along line 22—22.

FIG. 21 is a top plan view of a voltage controlled tunable dielectric capacitor 534 that can be used in the filters of this invention. FIG. 22 is a cross sectional view of the capacitor 534 of FIG. 21 taken along line 22—22. The capacitor includes a first electrode 536, a layer, or film, of tunable dielectric material 538 positioned on a surface 540 of the first electrode, and a second electrode 542 positioned on a side of the tunable dielectric material 538 opposite from the first electrode. The first and second electrodes are preferably metal films or plates. An external voltage source 544 is used to apply a tuning voltage to the electrodes, via lines 546 and 548. This subjects the tunable material between the first and second electrodes to an electric field. This electric field is used to control the dielectric constant of the tunable dielectric material. Thus the capacitance of the tunable dielectric capacitor can be changed.

Figure 23:
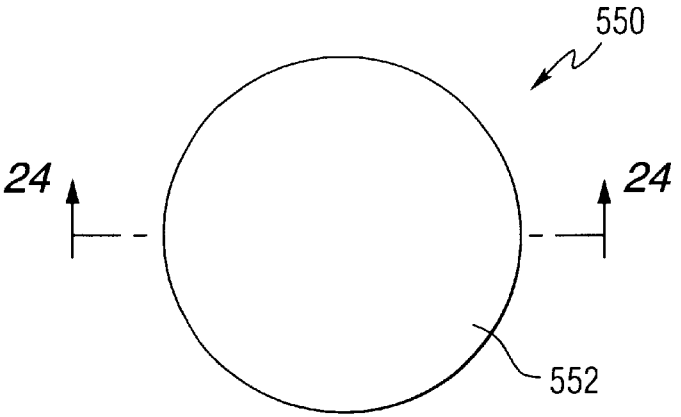
FIG. 23 is a top plan view of another voltage tunable dielectric varactor that can be used in the filters of the present invention.
Figure 24:
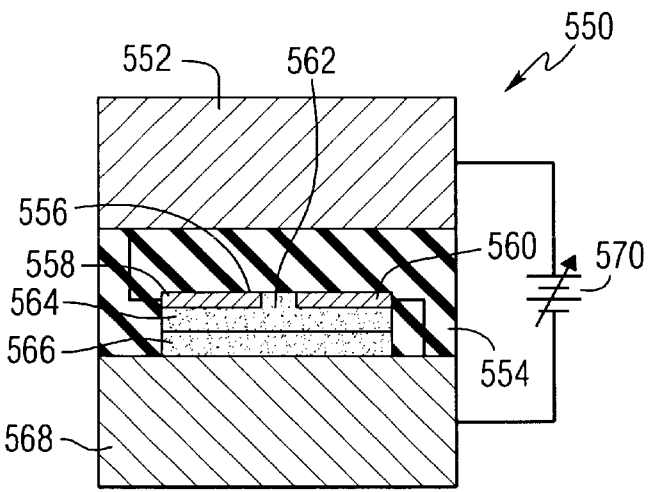
FIG. 24 is a cross sectional view of the varactor of FIG. 23, taken along line 24—24.

FIG. 23 is a top plan view of another voltage controlled tunable dielectric capacitor 550 that can be used in the filters of this invention. FIG. 24 is a cross sectional view of the capacitor of FIG. 23 taken along line 24—24. The tunable dielectric capacitor of FIGS. 23 and 24 includes a top conductive plate 552, a low loss insulating material 554, a bias metal film 556 forming two electrodes 558 and 560 separated by a gap 562, a layer of tunable material 564, a low loss substrate 566, and a bottom conductive plate 568. The substrate 566 can be, for example, MgO, $LaAlO_3$, alumina, sapphire or other materials. The insulating material can be, for example, silicon oxide or a benzocyclobutene-based polymer dielectrics. An external voltage source 570 is used to apply voltage to the tunable material between the first and second electrodes to control the dielectric constant of the tunable material.

The tunable dielectric film of the capacitors shown in FIGS. **22*a* and 24*a*, is typical Barium-strontium titanate, $Ba_xSr_{1-x}TiO_3$ (BSTO) where $0<x<1$, BSTO-oxide composite, or other voltage tunable materials. Between electrodes 558 and 560, the gap 562** has a width g, known as the gap distance. This distance g must be optimized to have higher $C_{max}/C_{min}$ in order to reduce bias voltage, and increase the Q of the tunable dielectric capacitor. The typical g value is about 10 to 30 μm. The thickness of the tunable dielectric layer affects the ratio $C_{max}/C_{min}$ and Q. For tunable dielectric capacitors, parameters of the structure can be chosen to have a desired trade off among Q, capacitance ratio, and zero bias capacitance of the tunable dielectric capacitor. It should be noted that other key effect on the property of the tunable dielectric capacitor is the tunable dielectric film. The typical Q factor of the tunable dielectric capacitor is about 200 to 500 at 1 GHz, and 50 to 100 at 20 to 30 GHz. The $C_{max}/C_{min}$ ratio is about 2, which is independent of frequency.

The tunable dielectric capacitor in the preferred embodiment of the present invention can include a low loss (Ba, Sr)$TiO_3$-based composite film. The typical Q factor of the tunable dielectric capacitors is 200 to 500 at 2 GHz with capacitance ratio ($C_{max}/C_{min}$) around 2. A wide range of capacitance of the tunable dielectric capacitors is variable, say 0.1 pF to 10 pF. The tuning speed of the tunable dielectric capacitor is less than 30 ns. The practical tuning speed is determined by auxiliary bias circuits. The tunable dielectric capacitor is a packaged two-port component, in which tunable dielectric can be voltage-controlled. The tunable film is deposited on a substrate, such as MgO, $LaAlO_3$, sapphire, $Al_2O_3$ and other dielectric substrates. An applied voltage produces an electric field across the tunable dielectric, which produces an overall change in the capacitance of the tunable dielectric capacitor.

Tunable dielectric materials have been described in several patents. Barium strontium titanate ($BaTiO_3$-$SrTiO_3$), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO-MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO—ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. Patent Applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; U.S. application Ser. No. 09/834,327 filed Apr. 13, 2001, entitled "Strain-Relieved Tunable Dielectric Thin Films"; and U.S. Provisional Application Ser. No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf. Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In one embodiment, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths. The high Q tunable dielectric capacitor utilizes low loss tunable substrates or films.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

Compared to semiconductor varactor based tunable filters, the tunable dielectric capacitor based tunable filters of this invention have the merits of lower loss, higher power-handling, and higher IP3, especially at higher frequencies (>10 GHz).

The filters of the present invention have low insertion loss, fast tuning speed, high power-handling capability, high IP3 and low cost in the microwave frequency range. Compared to the voltage-controlled semiconductor varactors, voltage-controlled tunable dielectric capacitors have higher Q factors, higher power-handling and higher IP3. Voltage-controlled tunable dielectric capacitors have a capacitance that varies approximately linearly with applied voltage and can achieve a wider range of capacitance values than is possible with semiconductor diode varactors.

Accordingly, the present invention, by utilizing the unique application of high Q tunable dielectric capacitors, can provide high performance, small size tunable filters that are suitable for use in wireless communications devices. These filters provide improved selectivity without complicating the filter topology.

While the present invention has been described in terms of its preferred embodiments, it will be apparent to those skilled in the art that various changes can be made to the disclosed embodiments without departing from the scope of the invention as set forth in the following claims.

What is claimed is:

1. An electronic filter including:

a substrate with a generally planar first surface, said substrate comprising a ferroelectric layer positioned adjacent to said first surface;

a ground conductor positioned beneath said ferroelectric layer;

a first linear microstrip positioned on said first surface of the substrate and having a first end connected to the ground conductor;

a first capacitor connected between a second end of the first linear microstrip and the ground conductor;

a second linear microstrip, positioned on the first surface of the substrate parallel to the first linear microstrip, and having a first end connected to the ground conductor;

a second capacitor connected between a second end of the second linear microstrip and the ground conductor;

a third linear microstrip positioned on the first surface of the substrate between the first and second linear microstrips and parallel to the first and second linear microstrips, and having a first end connected to the ground conductor;

a third capacitor connected between a second end of the third linear microstrip and the ground conductor;

a U-shaped microstrip positioned between the first and third linear microstrips, the U-shaped microstrip including first and second extensions positioned parallel to the first, second and third linear microstrips;

a fourth capacitor connected between a first end of the first extension of the U-shaped microstrip and the ground conductor;

a fifth capacitor connected between a first end of the second extension of the U-shaped microstrip and the ground conductor;

an input coupled to the first linear microstrip, wherein each of the fourth and fifth capacitors comprises a voltage tunable dielectric capacitor including a pair of metal electrodes positioned on top of said ferroelectric layer; and an output coupled to the second linear microstrip.

2. The electronic filter of claim 1, wherein said ferroelectric layer has a permittivity in a range from about 20 to about 2000, and having a tunability in the range from about 10% to about 80% when biased by an electric field of about 10 V/$\mu$m.

3. The electronic filter of claim 2, wherein said ferroelectric layer is a voltage tunable dielectric film, said film comprises:

barium strontium titanate or a composite of barium strontium titanate.

4. The electronic filter of claim 1, wherein said electrodes are separated to form a gap.

5. The electronic filter of claim 4, further comprising:

an insulating material positioned between said pair of metal electrodes for insulating said pair of metal electrodes and the tunable dielectric film from first and second cavity resonators.

6. The electronic filter of claim 1, wherein:

the U-shaped microstrip includes a shorted portion positioned adjacent to the first ends of the first and third linear microstrips.

7. The electronic filter of claim 1, wherein:

the U-shaped microstrip includes a shorted portion positioned adjacent to the second ends of the first and third linear microstrips.

8. An electronic filter including:

a substrate with a generally planar first surface, said substrate comprising a ferroelectric layer positioned adjacent to said top surface;

a ground conductor positioned beneath said ferroelectric layer;

a first linear microstrip positioned on a first surface of the substrate and having a first end connected to the ground conductor;

a first capacitor connected between a second end of the first linear microstrip and the ground conductor;

a second linear microstrip, positioned on the first surface of the substrate parallel to the first linear microstrip, and having a first end connected to the ground conductor;

a second capacitor connected between a second end of the second linear microstrip and the ground conductor;

a first U-shaped microstrip positioned between the first and second linear microstrips, the first U-shaped microstrip including first and second extensions positioned parallel to the first and second linear microstrips;

a third capacitor connected between a first end of the first extension of the first U-shaped microstrip and the ground conductor;

a fourth capacitor connected between a first end of the second extension of the first U-shaped microstrip and the ground conductor;

a second U-shaped microstrip positioned between the first and second linear microstrips, the second U-shaped microstrip including third and fourth extensions positioned parallel to the first and second linear microstrips;

a fifth capacitor connected between a first end of the third extension of the second U-shaped microstrip and the ground conductor;

a sixth capacitor connected between a first end of the fourth extension of the second U-shaped microstrip and the ground conductor, wherein each of the third, fourth, fifth and six capacitors comprises a voltage tunable dielectric capacitor including a pair of metal electrodes positioned on top of said ferroelectric layer;

an input coupled to the first linear microstrip; and an output coupled to the second linear microstrip.

9. The electronic filter of claim 8, wherein said ferroelectric layer has a permittivity in a range from about 20 to about 2000, and having a tunability in the range from about 10% to about 80% when biased by an electric field of about 10 V/$\mu$m.

10. The electronic filter of claim 9, wherein said ferroelectric layer is a voltage tunable dielectric film, said film comprises:

barium strontium titanate or a composite of barium strontium titanate.

11. The electronic filter of claim 8, wherein said electrodes are separated to form a gap.

12. The electronic filter of claim 11, further comprising:

an insulating material position between said pair of metal electrodes for insulating said pair of metal electrodes and the tunable dielectric film from first and second cavity resonators.

13. The electronic filter of claim 8, wherein each of the first and second U-shaped microstrips includes a shorted portion positioned adjacent to the first ends of the first and second linear microstrips.

14. The electronic filter of claim 8, wherein each of the first and second U-shaped microstrips includes a shorted portion positioned adjacent to the second ends of the first and third linear microstrips.

* * * * *

UNITED STATES PATENT AND TRADEMARK OFFICE

CERTIFICATE OF CORRECTION

PATENT NO. : 6,597,265 B2
DATED : July 22, 2003
INVENTOR(S) : Liang et al.

It is certified that error appears in the above-identified patent and that said Letters Patent is hereby corrected as shown below:

Column 10,
Line 34, replace "FIGS. 22a and 24a" with -- FIGS. 22 and 24 --
Line 36, replace "Between" with -- As shown in FIG. 24 and between --

Signed and Sealed this

Twenty-seventh Day of January, 2004

JON W. DUDAS
*Acting Director of the United States Patent and Trademark Office*